US006638009B2

(12) United States Patent
Honma

(10) Patent No.: US 6,638,009 B2
(45) Date of Patent: Oct. 28, 2003

(54) IMPELLER OF LIQUID PUMP

(75) Inventor: Bunji Honma, Ohta (JP)

(73) Assignee: Mitsuba Corporation, Kiryu (JP)

( * ) Notice: Subject to any disclaimer, the term of this patent is extended or adjusted under 35 U.S.C. 154(b) by 0 days.

(21) Appl. No.: 10/135,698

(22) Filed: May 1, 2002

(65) Prior Publication Data

US 2002/0168261 A1 Nov. 14, 2002

(30) Foreign Application Priority Data

May 9, 2001 (JP) ..... 2001-138907

(51) Int. Cl.[7] ..... F04D 5/00
(52) U.S. Cl. ..... 415/55.1; 416/223 R; 416/237
(58) Field of Search ..... 415/55.1, 55.2, 415/55.6, 55.7; 416/223 R, 237

(56) References Cited

U.S. PATENT DOCUMENTS 5,328,325 A * 7/1994 Strohl et al. ..... 415/55.1
5,449,269 A * 9/1995 Frank et al. ..... 415/55.1
5,807,068 A 9/1998 Dobler et al.
6,224,323 B1 5/2001 Murase et al.
6,454,520 B1 * 9/2002 Pickelman et al. ..... 415/55.1
6,471,466 B2 * 10/2002 Marx et al. ..... 415/55.1

FOREIGN PATENT DOCUMENTS

JP 9-511812 11/1997
WO WO 99/07990 2/1999

* cited by examiner

*Primary Examiner*—Ninh H. Nguyen
(74) *Attorney, Agent, or Firm*—Oliff & Berridge, PLC

(57) ABSTRACT

An impeller for liquid pump that is capable of improving pump efficiency by modifying a shape of the impeller. An impeller is rotatably provided in a pump section of a fuel pump. A plurality of through holes are formed in the impeller so as to extend in an axial direction adjacent a circumference of a disk plate member. By doing so, a plurality of vanes and an outer-radial side ring portion are formed. An intake portion for the liquid, that is, a radial inner surface of the through hole that guides the liquid is inclined so that its rotating direction leading side is positioned to the inner-radial side, and thereby, a wider fluid guiding area is secured.

20 Claims, 9 Drawing Sheets

IMPELLER OF LIQUID PUMP

BACKGROUND OF THE INVENTION

1. Field of Invention

The invention relates to the technical field of an impeller for a liquid pump provided in the fuel tank of vehicle and pumping a liquid.

2. Description of Related Art

This type of liquid pump is, for example, a fuel pump arranged in a fuel tank. In general, a fuel pump having the following structure is well known. More specifically, an impeller is rotatably mounted in a pump chamber, which is formed with an intake port and an outlet port at its outer-radial portion, and fuel flowing from the intake port is pumped from the outlet port based on a rotation of the impeller. The impeller of the fuel pump has a structure as shown in FIGS. 8(A)–8(C), for example. That is, a disk plate member (impeller) 14 having a predetermined plate thickness is formed with a plurality of vanes 14*a*, which extend substantially radially or approximately perpendicular to a tangent to the circumferential direction, and a plurality of vane grooves 14*b* are interposed between adjacent vanes 14*a*, at the outer periphery. The vanes 14*a* and vane grooves 14*b* are formed on both plate surfaces (both sides) so that they can be alternately positioned on opposite sides of the intermediate portion M of the disk plate member 14. In the impeller, the vane groove 14*b* has an inclined surface 14*c*, which is formed so that the inner-radial edge portion reaches the plate surface of the disk plate member 14. With the rotation of the impeller 14, fuel flowing from the intake port flows from the inner-radial side of the inclined surface 14*c* to the outer-diameter side thereof along the inclined surface 14*c*. Then, the fuel is rotated while forming a vortex flow between the inclined surface and a ring recess groove for a passage formed in the impeller casing that constitutes a pump chamber, and is pumped from the outlet port formed at the outer-radial side (see the outlined arrow shown in FIG. 8(A)). In the impeller, the fuel flow is analyzed based on CFD (Computational Fluid Dynamics); as a result, the following problems (see FIGS. 8(B) and 8(C)) are found. First, there exists a flow colliding with a rotating direction (see arrow FIG. 8(A)) trailing surface 14*d* which generates, an impact loss. Second, another vortex flow, different from the previously described vortex flow, is formed backward from a rotating direction leading surface 14*e* such that cavitation results. Third, stagnation is generated in the thickness direction intermediate portion of the outer-radial portion of the impeller 14 which generates a counter flow. The problems are a factor in reducing the pump's efficiency. The mentioned phenomena are believed to occur from the following cause. That is, the vortex flow flows later than a rotational speed of the vane 14*a*; on the contrary, the shape of the vane 14*a* (vane surface) of the impeller 14 is parallel to the thickness direction (rotary shaft direction) surface. Further, the outer-diameter edge portion of the vane 14*a* and the inner-radial surface of the impeller casing closely face each other.

In order to solve the problem, the impeller disclosed in Japanese Patent Application Publication (laid-open) No. 9-511812 has been proposed. As shown in FIG. 9(A), vanes 15*a* of an impeller 15 are formed between a plurality of through holes 15*b* formed along a circumferential direction of a disk plate member. A radially inner surface 15*c* of the through hole 15*b* is formed into a surface inclined with respect to the intermediate portion M (inner-diameter edge portion reaches plate surface) so that each plate surface is further inwardly inclined, and the inclined surface is used as a fuel passage. On the other hand, the plurality of vanes 15*a* are formed with a ring portion 15*d* at the outer radial side. Further, in the impeller 15, each vane 15*a* is formed in a state of being inclined to the rotary shaft of the disk plate member, that is, to the intermediate portion M of the disk plate member so that both plate surface sides of the disk plate member are positioned to a rotating direction leading side. The shape of the vortex flow is similar to that of the vane 15*a* (through hole 15*b*) so as to reduce a collision (impact loss) of the flow against a rotating direction trailing surface 15*e* of the through hole 15*b*.

In the impeller 15, the fuel flow is analyzed based on the CFD in the same manner as the conventional example; as a result, as shown in FIGS. 9(B) and 9(C), the following points are found. First, a counter flow by stagnation is reduced in the outer-diameter portion of the impeller 15. Second, the collision of fuel with the vane 15*a*, that is, the collision with rotating direction leading and trailing surfaces 15*f*, 15*e* of the through hole 15*b* is reduced. Third, a main vortex flow is smoothly formed in a state of running along the radial inner surface 15*c* of the through hole 15*b*. Therefore, the pump's efficiency is considered as improved. However, as seen from FIG. 9(B), in the fuel flow, a small vortex flow, which is different from the main vortex flow guided to the radially inner surface 15*c* and flowing to the outer-radial side, is formed backward of the rotating direction leading surface 15*f* of the vane groove 15*b*. Further, there exist flows which collide with the rotating direction leading and trailing surfaces 15*f*, 15*e*. As a result, like the conventional example, the cavitation and impact loss is generated as ever; therefore, these are factors in reducing the pump's efficiency.

On the other hand, in recent years, it is greatly desired to achieve a high output of a fuel pump, and to simultaneously make the fuel pump compact. In order to achieve the purpose, there is a need to further improve the pump's efficiency, and this is a problem to be solved by the invention.

SUMMARY OF THE INVENTION

The invention has been made in view of the circumstances, and therefore, an object of the invention is to solve the problems found in the prior art.

In order to achieve the object, the invention provides an impeller for liquid pump, the impeller provided in a pump chamber formed with an intake port and an outlet port, which is rotated so that a liquid taken from the intake port can be pumped from the outlet port, comprising:

- a plurality of through holes penetrating the thickness of a disk plate member and formed at an outer periphery of the disk plate member along the circumferential direction thereof; and
- a plurality of vanes formed between adjacent through holes,
- a radial inner surface of each though hole being inclined from a thickness direction intermediate portion to an inner-radial side in order to guide a liquid to the thickness direction intermediate portion side,
- the radial inner surface being inclined so that its rotating direction leading side is positioned to the inner-radial side in order to secure an area for guiding the liquid wider.

By doing so, the inflow portion of liquid, that is, the radial inner surface of the through hole has a wider area, and the flow rate of the main vortex flow increases. Therefore, pump efficiency can be improved.

Further, the invention provides the impeller for a liquid pump, wherein a radial outer surface of each though hole is inclined so that its rotating direction leading side is positioned to the inner-radial side.

Further, the invention provides the impeller for a liquid pump, wherein the radial outer surface of each though hole is inclined from the thickness direction intermediate portion to an outer-radial side of the through hole.

Further, the invention provides the impeller for a liquid pump, wherein the pump chamber is formed with a ring recess groove for a fluid passage, which faces a vane forming portion, and an inner-radial edge portion of the ring recess groove faces the rotating direction leading surface of the through hole; on the other hand, an outer-radial edge portion of the ring recess groove faces the rotating direction trailing surface thereof.

Further, the invention provides the impeller for a liquid pump, wherein the rotating direction leading and trailing surfaces of the through hole are inclined from the thickness direction intermediate portion to the rotating direction leading sides.

Further, the invention provides the impeller for a liquid pump, wherein the rotating direction leading and trailing surfaces of the through hole are inclined with respect to a radial line of the impeller so that their outer-radial sides are positioned to the rotating direction leading sides.

BRIEF DESCRIPTION OF THE DRAWINGS

These and further objects and features of the invention will become more fully apparent from the following detailed description with reference to the accompanying drawings in which.

DETAILED DESCRIPTION OF PREFERRED EMBODIMENTS

Figure 1:
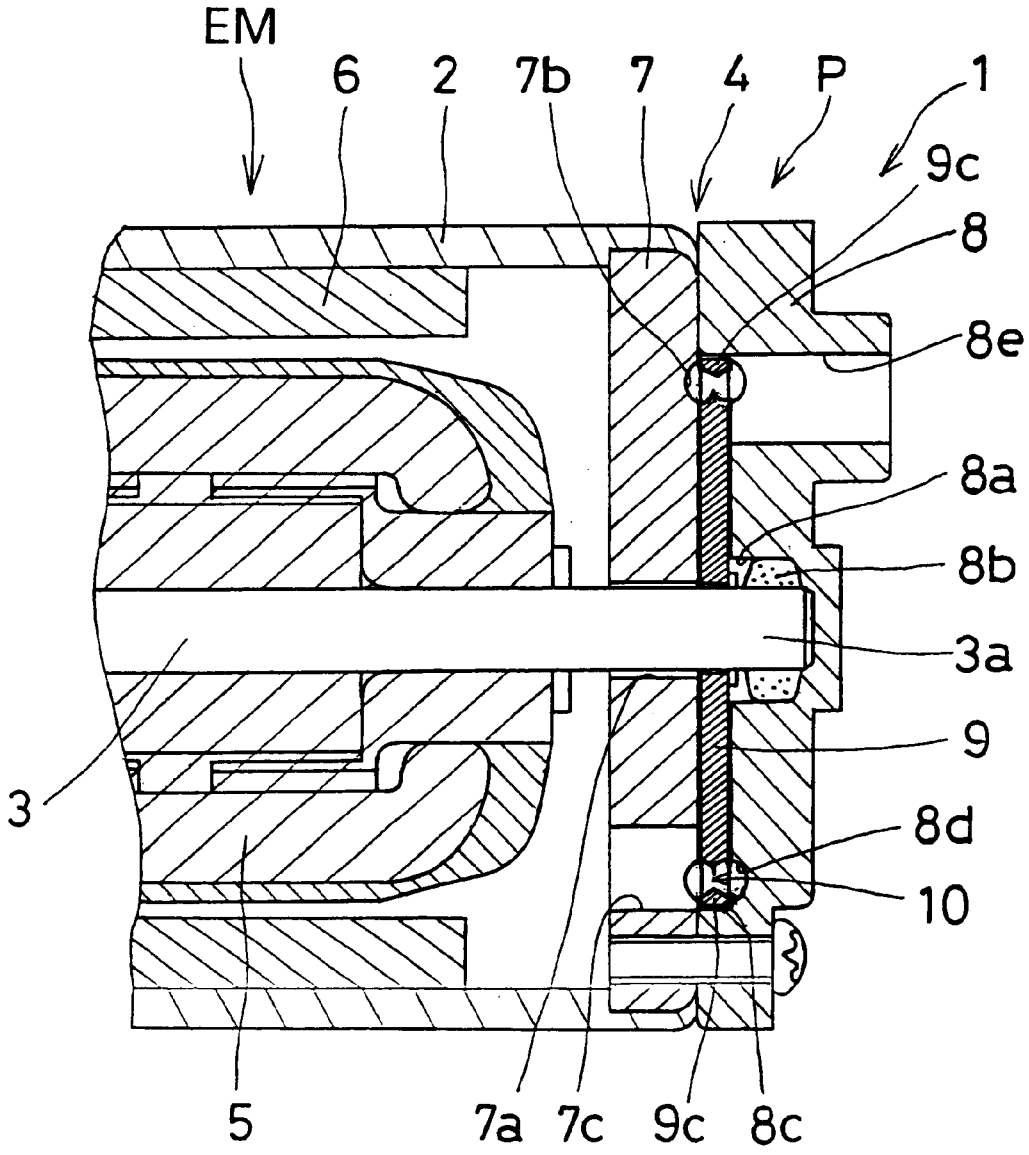
FIG. 1 is a side view partly in cross section showing a fuel pump.
Figure 2A:
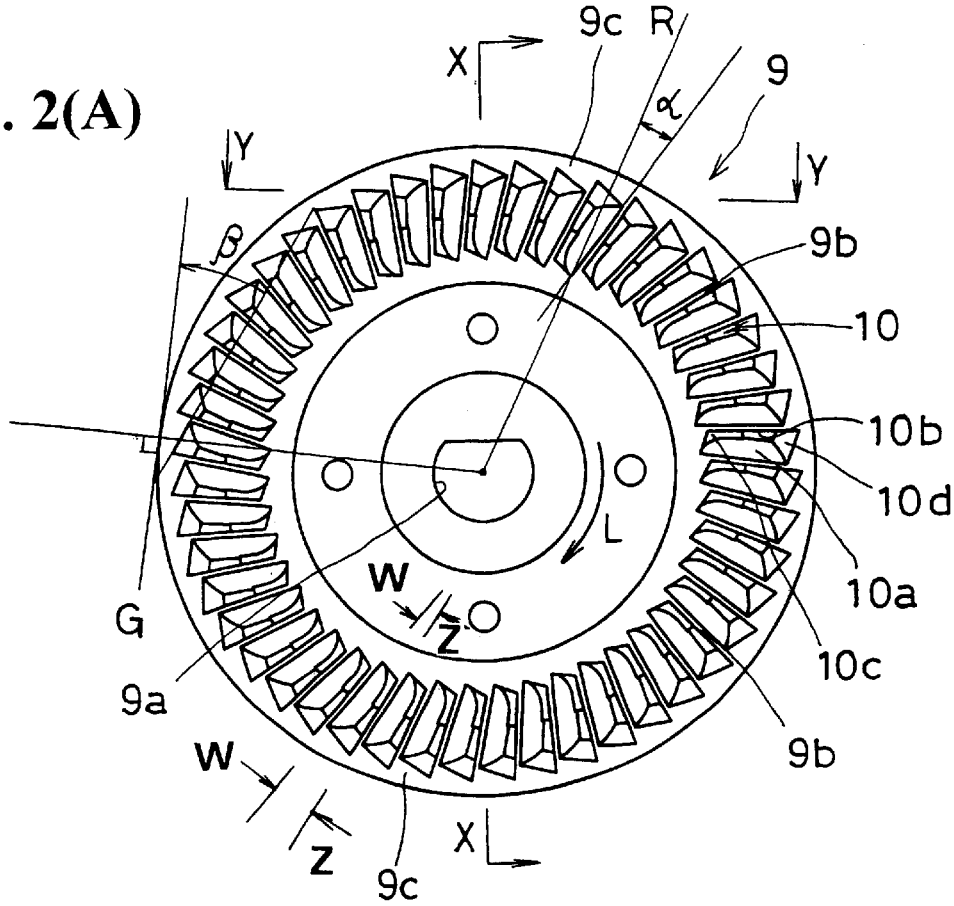
FIG. 2(A) is a front view showing an impeller according to a first embodiment.
Figure 2B:
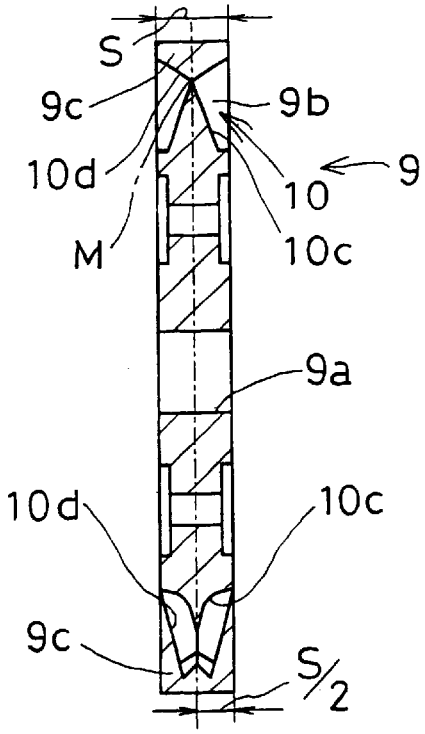
FIG. 2(B) is a cross sectional view taken along the line X—X of FIG. 2(A)

A first embodiment of the invention will be described below with reference to FIGS. 1 to 6. In FIG. 1, reference numeral 1 denotes a fuel pump arranged in a fuel tank. The fuel pump 1 has a structure in which one side of a cylindrical casing 2 incorporates a motor section EM, and the other end of the side is attached a pump section P. A motor shaft 3 of the motor section EM is rotatably supported by a bracket (not shown) arranged so as to cover the cylinder end of side of the casing 2 incorporating the motor section EM and to a pump casing 4 arranged so as to cover the cylinder end of the other side of the casing 2. Reference numeral 5 denotes an armature core fitted integrally into the outer periphery of the motor shaft 3, and reference numeral 6 denotes a permanent magnet fixed on the inner peripheral surface of the casing 2.

The pump casing 4 which constitutes a pump chamber in the invention is composed of a pair of first and second plates 7, 8 arranged in parallel to the axial direction of the motor shaft 3. An end portion 3*a* of the motor shaft 3 penetrates through a through hole 7*a* of the first plate 7 and is supported by a bearing portion 8*a* of the second plate 8 via a bearing 8*b*.

A recess portion 8*c* is formed between the facing first and second plates 7, 8 in the second plate 8 so that a predetermined space is formed. The space thus formed is provided with an impeller 9, which is fitted and fixed to the end portion 3*a* of the motor shaft 3 so as not to rotate with respect to the motor shaft 3. A portion of the first plate 7 facing the outer peripheral portion of the impeller 9 is formed with a ring recess groove 7*b* recessed in the axial direction. On the other hand, the outer-radial side of the recess portion 8*c* of the second plate 8, that is, a portion facing the outer peripheral portion of the impeller 9 is formed with a ring recess groove 8*d* recessed to a direction parallel to the axial direction but convex in the opposite direction and facing to the ring recess groove 7*b* of the first plate. The ring recess grooves 7*b*, 8*d* are formed according to a dimension described later, and used as a fuel passage together with a through hole 10 formed in the impeller 9 when the pumping operation by the impeller 9 occurs. Further, the first and second plates 7, 8 are formed with an outlet port 7*c* and an intake port 8*e*, which communicate with the recess grooves 7*b*, 8*d*, respectively. Thus, based on the rotation of the impeller 9 by the rotational drive of the motor shaft 3, fuel is taken from the intake port 8*e* in the second plate 8, and then is pumped from the outlet port 7*c* in the first plate 7 to the motor section EM side and, thereafter, is discharged from the motor section EM side.

The impeller 9 is assembled with the motor shaft 3 extending through through hole 9*a* in which the motor shaft 3 is non-rotatably fitted. The through hole 9*a* is at the central portion of a disk plate member having a predetermined thickness S. Further, the outer-radial portion of the impeller 9, that is, the portion whose sides face the first and second plate recess grooves 7*b*, 8*d* is formed with a plurality of through holes 10 for fuel passage. The through holes 10 penetrate the thickness S of the impeller 9 and are arranged circumferentially. By doing so, the outer-radial portion of the impeller 9 is formed with a plurality of vanes 9*b*, which are arranged circumferentially, between adjacent through holes 10. Further, the impeller 9 is formed with a ring portion 9*c*, which is integrated along the circumferential direction, on the outer-radial side of the vanes 9*b*.

Figure 3A:
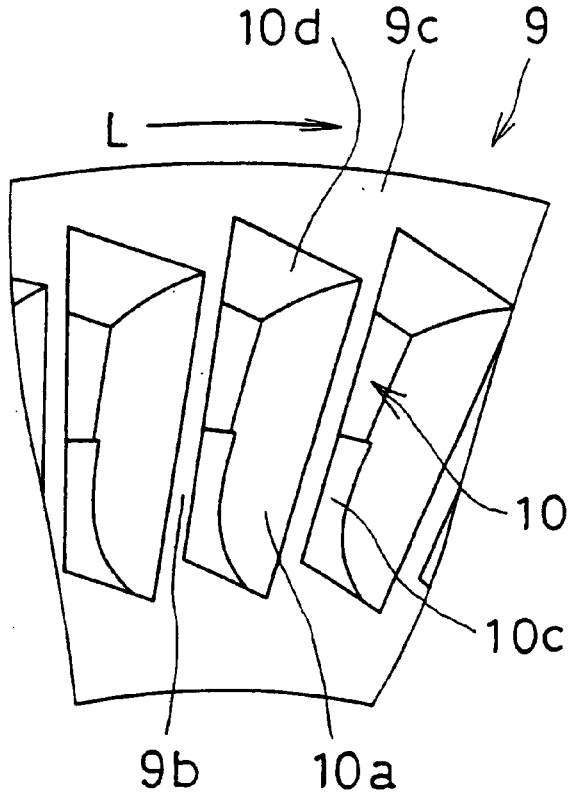
FIG. 3(A) is a partially enlarged front view showing the impeller.
Figure 3B:
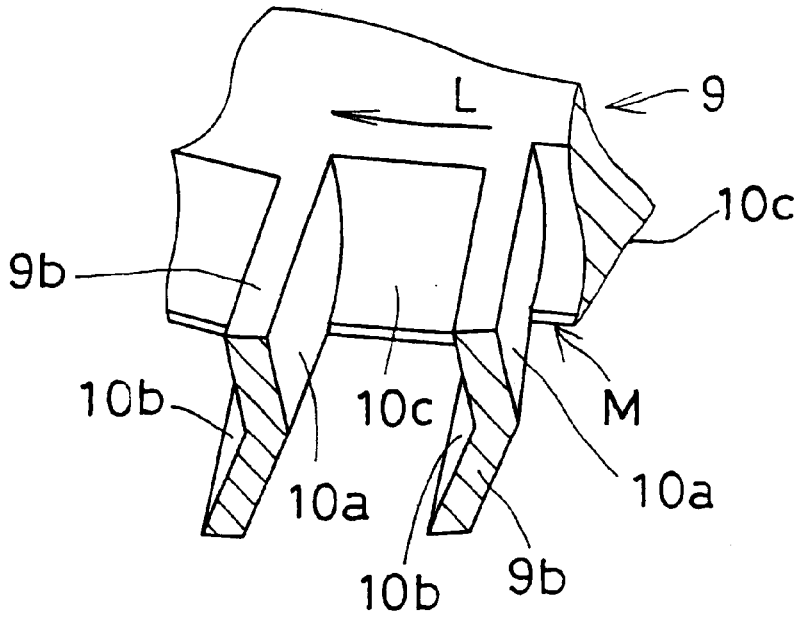
FIG. 3(B) is an enlarged perspective view, partly broken away, showing principal parts of the impeller.

The through holes 10 of the impeller 9, used as the fuel passages are each defined by four surrounding surfaces, that is, rotating direction leading and trailing surfaces 10*a*, 10*b* facing the rotating direction, and radial direction inner and outer surfaces 10*c*, 10*d*. Further, each through hole 10 is oriented substantially parallel to the axial direction. The rotating direction leading and trailing surfaces 10*a*, 10*b* are inclined from the thickness direction intermediate portion M, (having the thickness S) to have, when viewed in cross section (FIG. 3(B)) a V shape with the apex of the V at approximated a mid-point of each vane 9*b* (i.e., ≈S/2 is a leg length) so that the plate surface sides of the vanes 9*b*, i.e., the ends away from the apex, of the disk plate member (both sides of the disk plate member) are positioned to the rotating direction leading side. As seen in FIG. 3(B), the apex of the V shaped vanes 9*b* trails in the rotating direction. Further, the rotating direction leading and trailing surfaces 10*a*, 10*b* are inclined from the thickness direction intermediate portion M in the rotating direction as they extend toward the outer circumference of the impeller 9 (FIG. 2(A)). Thus, rotating direction leading and trailing surfaces 10*a*, 10*b* are formed into the V-shape surfaces using the intermediate portion M as the acute-angle groove. The V-shape rotating direction leading surfaces 10*a*, thus formed are inclined in a state of having an angle α with respect to a radial line R of the impeller 9. The trailing surfaces 10*b* are also included in the same direction although to a lesser angle. Thus, the outer-radial points of both the leading and trailing surfaces 10*a*, 10*b* are positioned to the rotating direction leading side. As noted, in this embodiment, the rotating direction leading and trailing surfaces 10*a*, 10*b* are formed in a state that the inclined angle a with respect to the radial line R is different. In this case, the angle may be properly set in accordance with various conditions, such as usage, kind of fuel, and the like.

Figure 9A:
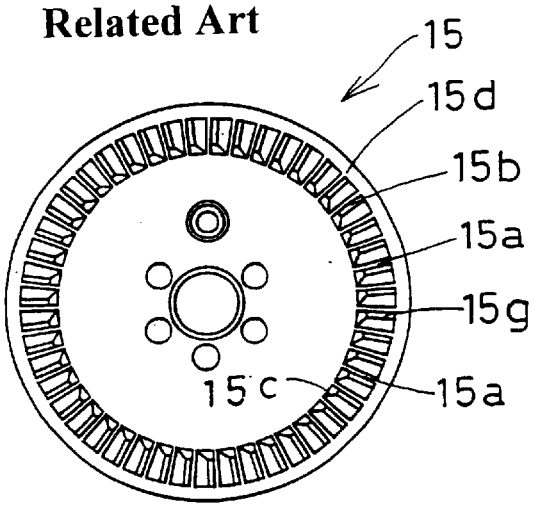
Fig. 9(A) Related Art
FIG. 9(A) is a front view, partly broken away, showing a conventional impeller.
Figure 9C:
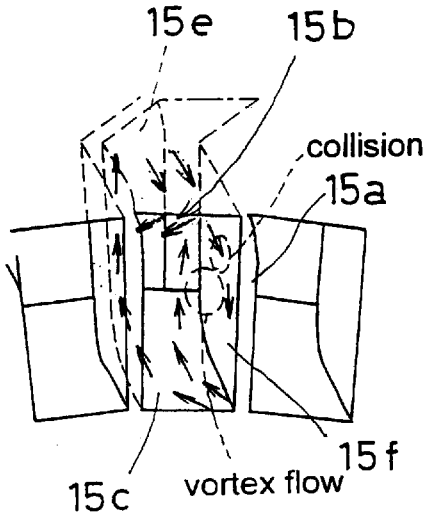
Fig. 9(C) Related Art
FIG. 9(C) is a view visibly showing the fuel flow in the through hole.
Figure 9B:
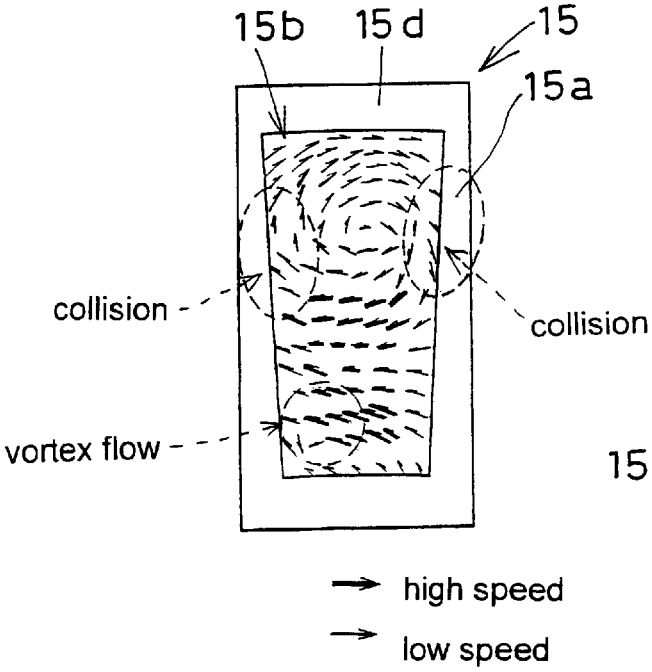
Fig. 9(B) Related Art
FIG. 9(B) is a perspective view to explain fuel passage in a through hole.
Figure 9D:
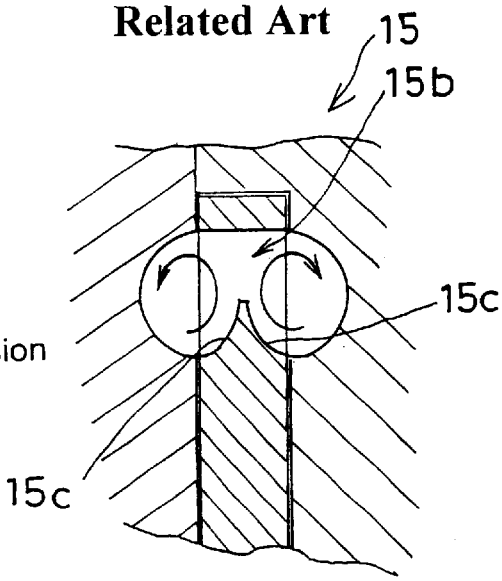
Fig. 9(D) Related Art
FIG. 9(D) is a cross sectional view to explain the fuel flow in the through hole.

Moreover, the radial direction outer and inner surfaces 10*c*, 10*d* of the through hole 10 are used as the inflow and outlet portions for the fuel, as described above. The radially outer and inner surfaces 10*d*, 10*c* are inclined from the surfaces of the thickness direction intermediate portion M to a midpoint of the thickness S, i.e., to a point defined by S/2. In particular, the outer and inner surfaces 10*d*, 10*c* are inclined away from the thickness direction intermediate portion M toward the outer radial side of the through hole 10. In this case, the inclined surface of the radial direction inner surface 10*c* is used as the inflow portion for the fuel, and is a surface for guiding the fuel. The inner surface 10*c* is formed into a pair of curved and inclined surface as the conventional case of FIG. 9(D). On the other hand, the outer surface 10*d* is formed into a pair of linearly inclined surfaces. Further, the outer and inner surfaces 10*d*, 10*c* are inclined at an angle p with respect to a tangent line G so that their rotating direction leading sides are positioned to the inner-radial side to the rotating direction trailing sides. By doing so, the radial direction outer and inner surfaces 10*d*, 10*c* are formed so as to extend toward the fuel inflow and outlet direction, thereby providing an increase in area.

In this embodiment, the radial direction outer and inner surfaces 10*d*, 10*c* are formed in a state that the inclined angle β with respect to the tangent line G is different between the outer and inner surfaces 10*d*, 10*c*. The angle may be properly set in accordance with various conditions, such as usage, kind of fuel and the like, similarly to the rotating direction leading and trailing surfaces 10*a*, 10*b*.

Figure 6A:
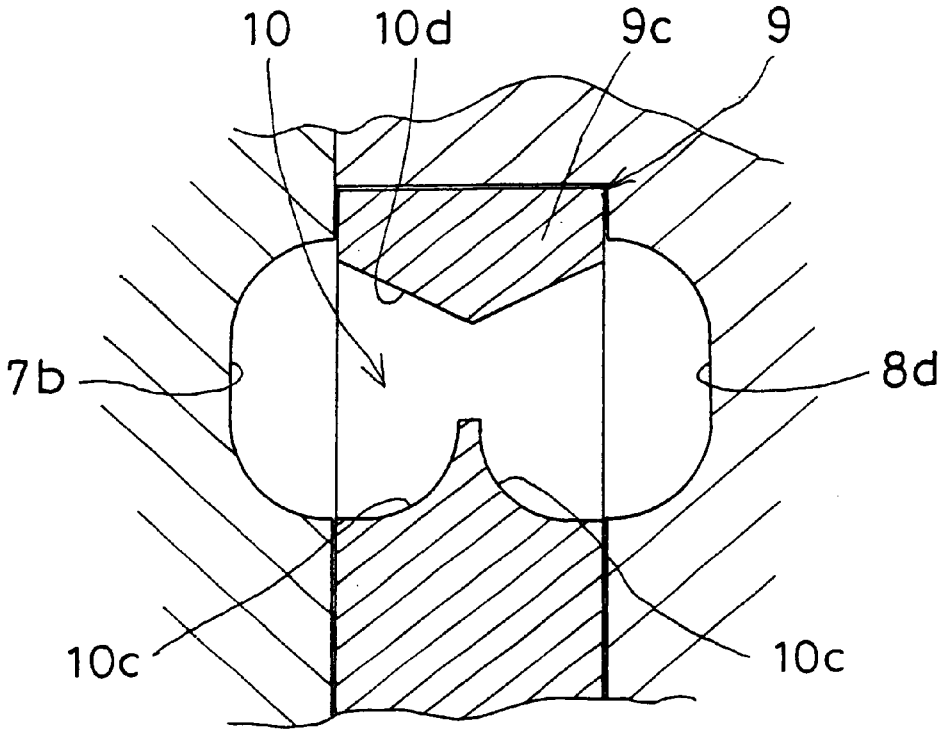
FIG. 6(A) is a cross sectional view taken along the W—W line of FIG. 2(A)
Figure 6B:
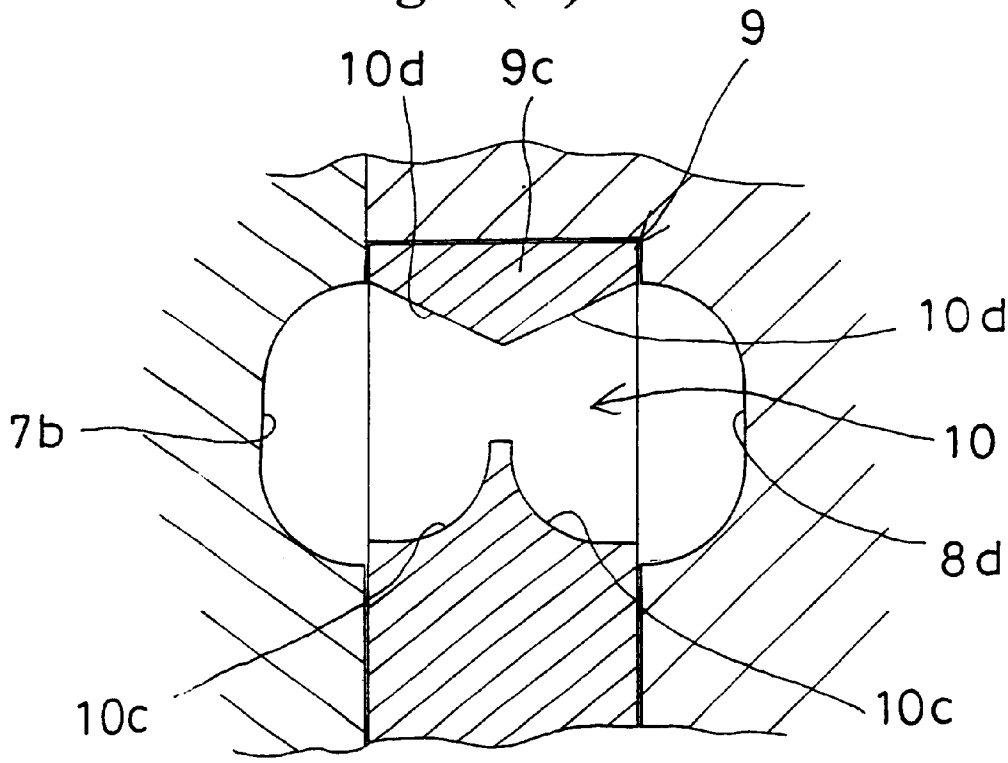
FIG. 6(B) is a cross sectional view taken along the Z—Z line of FIG. 2(A)

Moreover, the ring grooves 7*b*, 8*d*, formed in the first and second plates 7, 8, are formed in the following manner. The dimension of the inner-radial edge of the ring grooves 7*b*, 8*d* is set so as to face the inner-radial end of the rotating direction leading surface 10*a* of the through hole 10 and the outer radial edge of the ring grooves 7*b*, 8*d* corresponds to a circle defined by the dimension of the outer-radial edge of the ring grooves 7*b*, 8*d* and is set so as to face the outer-radial end of the rotating direction trailing surface 10*b* of the through hole 10. By doing so, the ring grooves 7*b*, 8*d* are shifted in position with respect to the radial inner and outer surfaces 10*c*, 10*d* when facing the through hole 10, and thereby, a stepped portion is formed in the fluid passage. However, as shown in FIG. 6(A), in the inflow portion, that is, the rotating direction leading inner-radial side of the through hole 10, and, as shown in FIG. 6(B), in the outlet portion, that is, the rotating direction trailing outer-radial side thereof, no stepped portion is formed. More specifically, no stepped portion is formed between the radial inner surface 10*c* and the ring recess grooves 7*b*, 8*d* and between the radial outer surface 10*d* and the ring recess grooves 7*b*, 8*d*.

Next, the flow state of fuel through the impeller 9, formed as above, will be described below based on the analysis using the CFD with reference to FIGS. 4(A) and 4(B). In this case, the motor shaft 3 is driven, and the impeller 9 is rotated in the direction shown by arrow L.

In this case, the impeller 9 is set so as to rotate in the arrow L direction. As such, the vane 9*b* is rotated in the L direction and, thereby, the fuel flows in the following manner. Namely, the fuel is taken from the second plate intake port 8*e*, and flows into the fluid passage space formed by each through hole 10 and the first and second plate recess grooves 7*b*, 8*d* toward the rotating direction backward side while forming the vortex flow. Thereafter, the fuel is discharged from the first plate outlet port 7*c* to the motor section EM side.

Figure 4A:
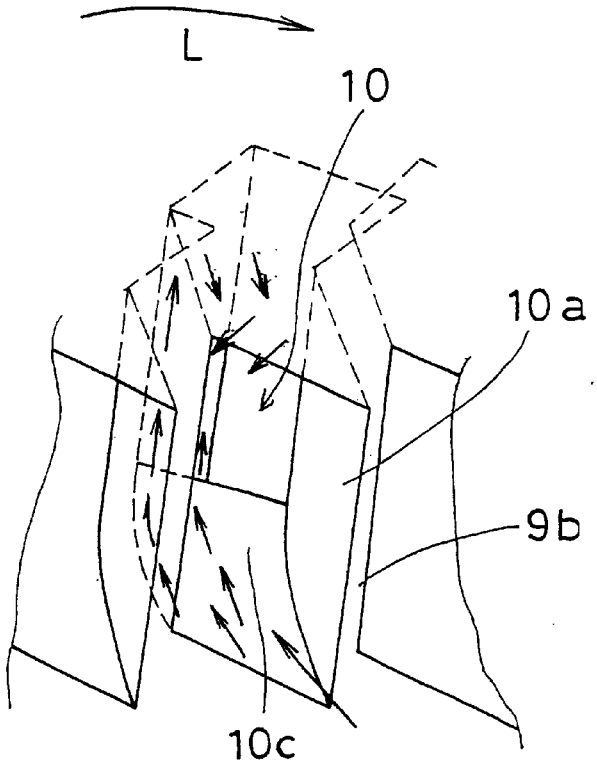
FIG. 4(A) is a perspective view to explain fuel passage in a through hole.
Figure 4B:
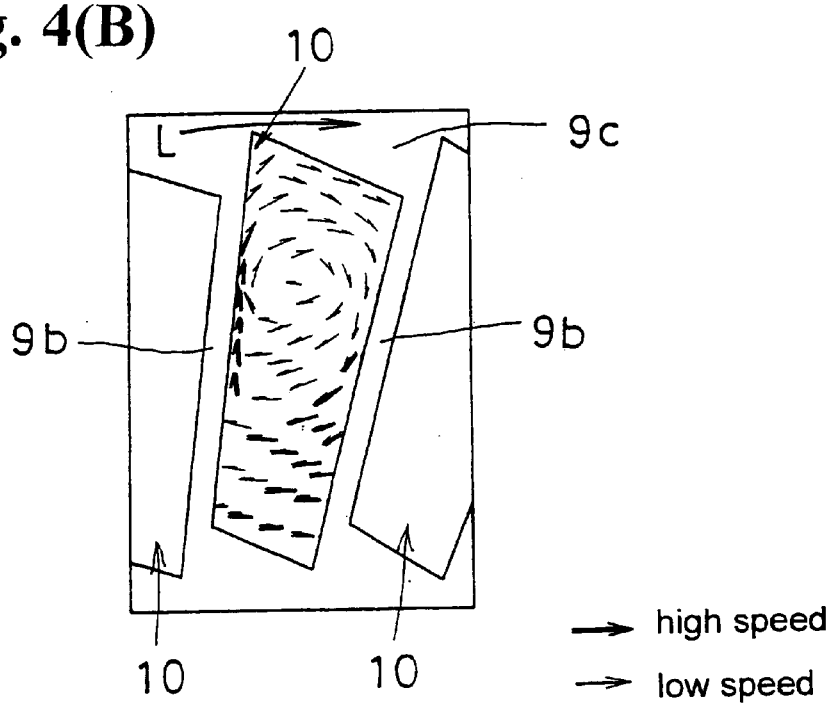
FIG. 4(B) is a view visibly showing the fuel flow in the through hole.
Figure 5A:
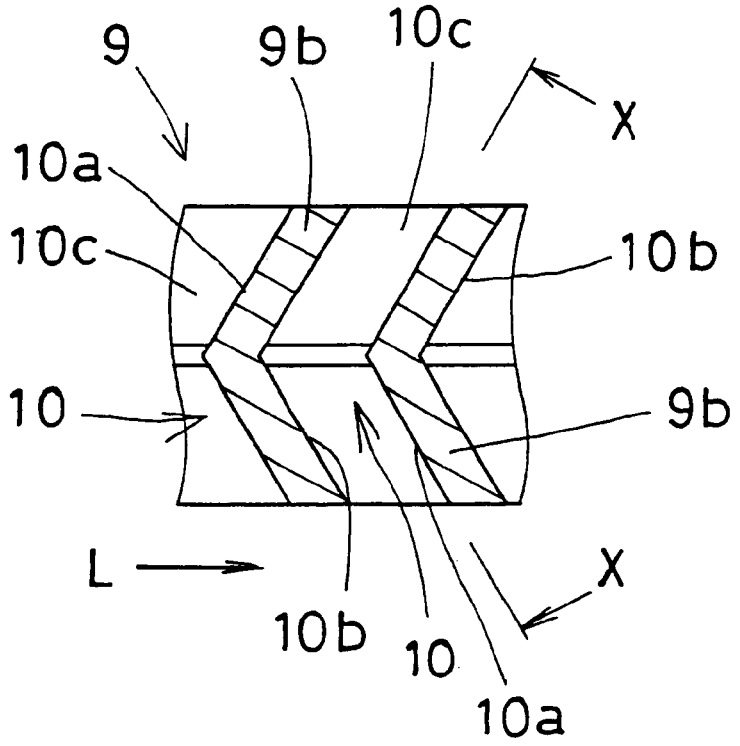
FIG. 5(A) is a cross sectional view taken along the Y—Y line of FIG. 2(A)
Figure 5B:
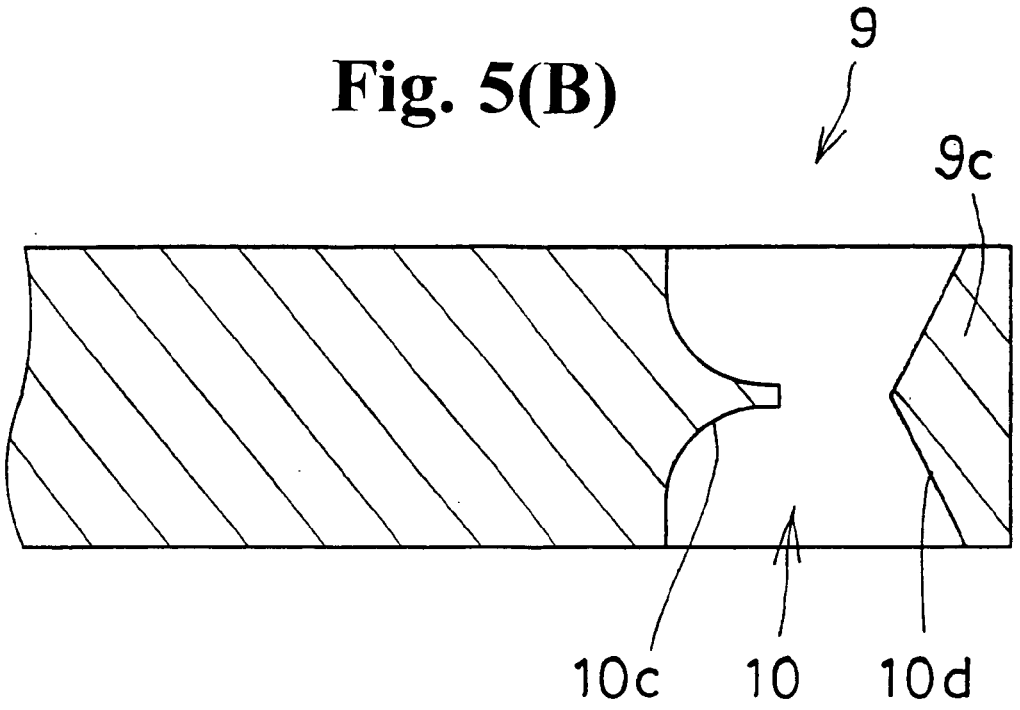
FIG. 5(B) is a cross sectional view taken along the X—X line of FIG. 5(A)

FIGS. 4(A) and 4(B) both show the flow of fuel in a through hole 10. The fuel is taken from the portion on the inner-radial side of the radial inner surface 10*c* of the through hole 10 and the rotating direction leading side, and flows toward the portion on the thickness direction intermediate portion M side of the radial outer surface 10*d* and the rotating direction trailing side. Namely, the fuel flows along the vane 9*b*. As a result, a small vortex, in addition to the main vortex flow, is not formed avoiding the problem of the conventional art.

This results from not only the fact that the rotating direction leading and trailing surfaces 10*a*, 10*b* of the through hole 10 are inclined from the thickness direction intermediate portion M toward the rotating direction leading side so that the shape of the through hole 10 is formed similarly to the vortex flow but also from the fact that the inflow and outlet portions, that is, the radial inner and outer surfaces 10*c*, 10*d* are formed so that their rotating direction leading side is inclined so as to be positioned to the inner radial side, and thereby, the area obtained for the surfaces 10*c*, 10*d* is wider than the conventional art.

Namely, as described above, the fuel is taken from the portion on the inner-radial side of the radial inner surface 10*c* of the through hole 10 and the rotating direction leading side 10*a*, flows toward the portion on the thickness direction intermediate portion M of the radial outer surface 10*d* and the rotating direction trailing side 10*b*, to become the main vortex flow. For this reason, in order to improve pump efficiency, it is necessary to increase the flow rate of the main vortex flow. In this embodiment, the radial inner surface 10*c* guides the fuel so that the main vortex flow can be formed, and has a wide area. Therefore, for the fuel it is easy to concentrate the flow and form the vortex flow. It is also possible to prevent a vortex flow other than the main vortex flow from being formed.

As described above, in each impeller through hole 10 and the ring recess grooves 7*b*, 8*d* of the pump casing 4, no stepped portion is formed in the inflow portion, that is, the rotating direction leading inner-radial side of the through hole 10, and in the outlet portion, that is, the rotating direction trailing outer-radial side thereof. Therefore, as impact loss is generated in the flow at the side where a stepped portion is formed; in the invention, no stepped portion is formed in the side (intake portion, outlet portion) where the liquid is taken and discharged avoiding impact loss. As a result, a large amount of fuel is guided to the flow forming the main vortex flow, and further flow can be concentrated.

In order to compare the fuel pump 1 of this first embodiment with the fuel pump including the conventional impellers shown in FIGS. 8(A)–8(C) and 9(A)–9(D), the pump efficiency was measured under identical conditions. As a result, the fuel pump using the impeller 14 shown in FIGS. 8(A)–8(C) had a pump efficiency of 19.3%, and the fuel pump using the impeller 15 shown in FIGS. 9(A)–9(D) had a pump efficiency of 36.1%. On the other hand, the fuel pump 1 of this first embodiment had a pump efficiency of 38.9%; therefore, the improved effect of the invention was proved.

As described above, in this embodiment of the invention, when the motor shaft 3 rotates with the drive of the motor section EM, the impeller 9 rotates so that the fuel pump operation by the vanes 9*b* is accomplished. In this case, the radial inner and outer surfaces 10*c*, 10*d* of the through hole 10 have a wide area because their rotating direction leading sides are inclined to the inner-radial side. As a result, the fuel is taken and discharged in a state of being concentrated (guided) along the inner and outer surfaces 10*c*, 10*d*; therefore, the flow rate of the main vortex flow can be increased. Further, the stepped portion is formed at the portion facing the ring recess grooves 7*b*, 8*d* of the pump casing 4 side and the through hole 10; however, no stepped portion is formed along the main vortex flow. Therefore, the flow is concentrated on the portion having no stepped portion, so that the flow rate of the main vortex flow can be increased. In addition, the rotating direction leading and trailing surfaces 10*a*, 10*b* are inclined to the radial line so that their outer edges are positioned further to the rotating direction leading side; therefore, the rotating direction leading and trailing surfaces 10*a*, 10*b* have a shape similar to that of the vortex flow. As a result, it is possible to prevent a reduction in pump efficiency by impact loss and cavitation; therefore, the pump efficiency is improved.

As is evident from the description, according to this embodiment, it is possible to further improve the pump efficiency, and to make fuel pump at a high output, and further, to achieve a downsizing of the fuel pump. As described above, the pump efficiency is improved, and thereby, it is possible to reduce a rotational speed for securing a required outlet amount, and to provide a silent, durable fuel pump.

Figure 7A:
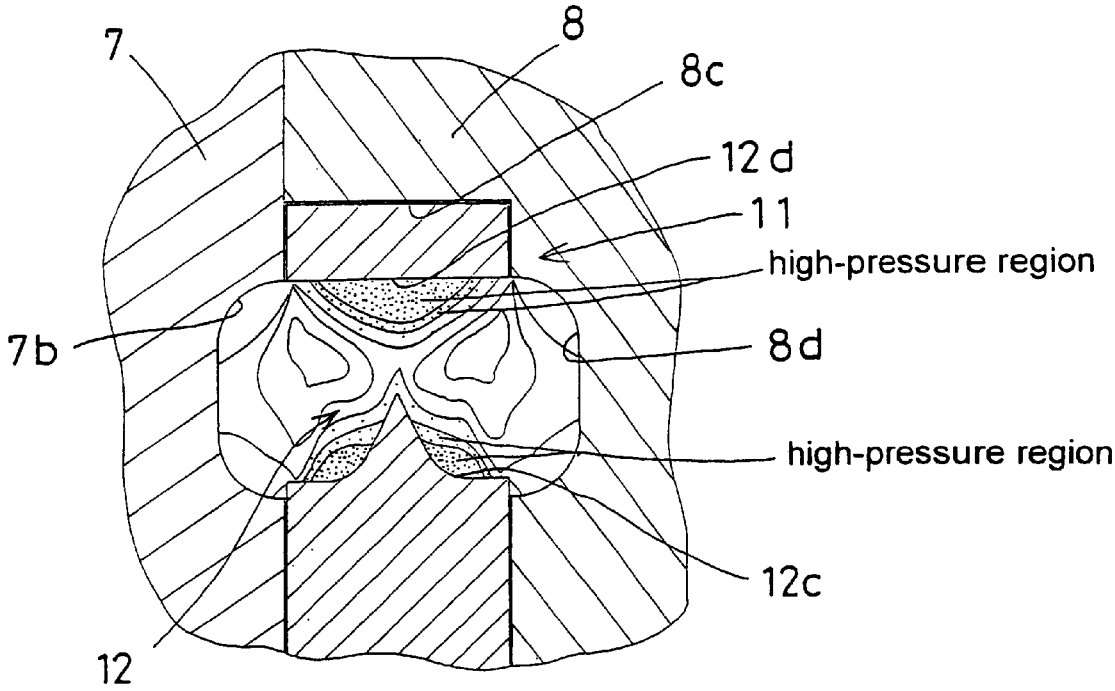
FIG. 7(A) is an enlarged side view showing principal parts of an impeller according to a second embodiment and is a pattern view to explain a fluid pressure in a fuel passage.
Figure 7B:
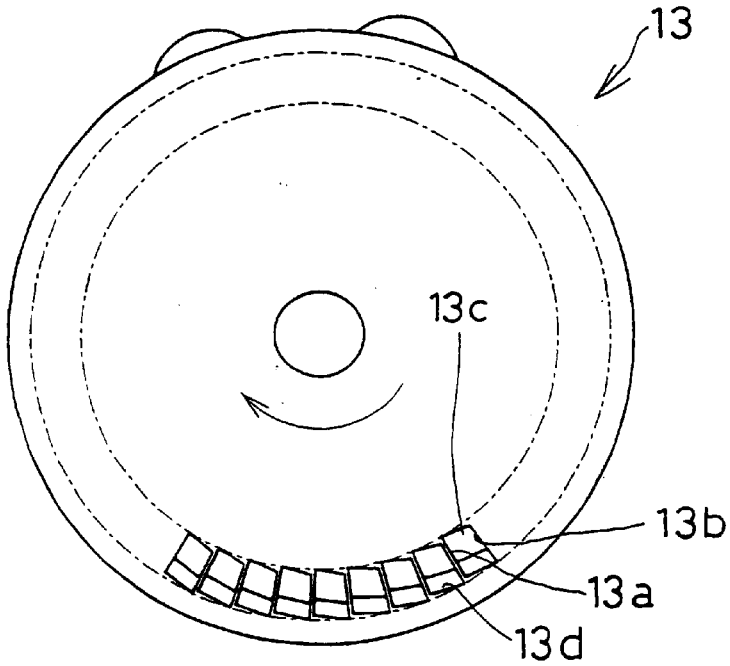
FIG. 7(B) is a front view showing an impeller according to a third embodiment.
Figure 8A:
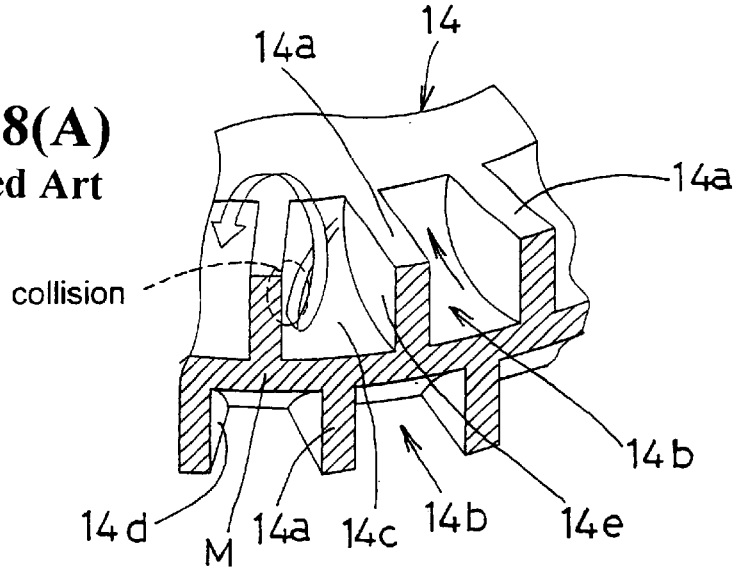
Fig. 8(A) Related Art
FIG. 8(A) is a perspective view, partly broken away, showing a conventional impeller.
Figure 8B:
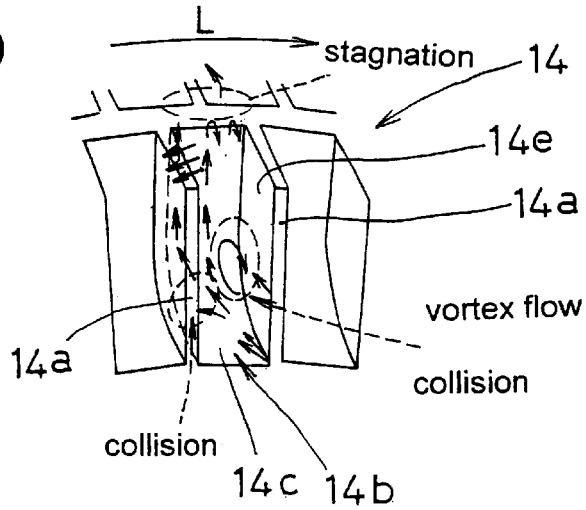
Fig. 8(B) Related Art
FIG. 8(B) is a perspective view to explain fuel passage in a through hole.
Figure 8C:
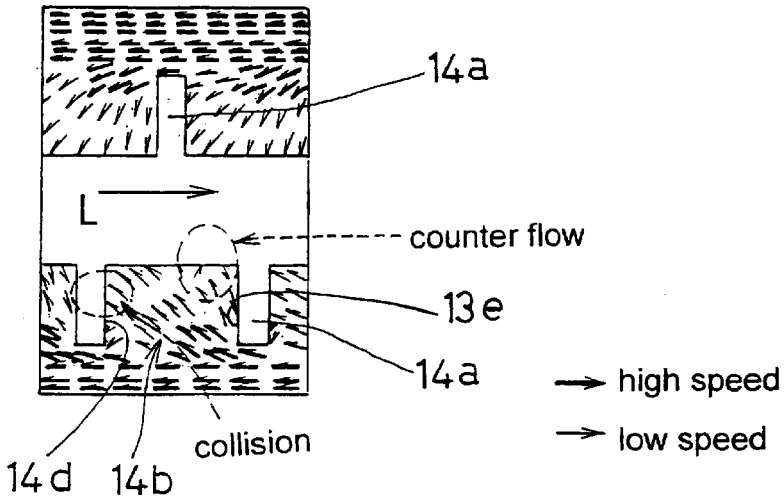
Fig. 8(C) Related Art
FIG. 8(C) is a view visibly showing the fuel flow in the through hole.

Of course, the invention is not limited to the described embodiment, and may be modified according to the second and third embodiments as shown in FIGS. 7(A) and 7(B). In an impeller 11 of the second embodiment shown in FIG. 7(A), a radial outer side 12*d* of a through hole 12 formed in the impeller 11 is formed into a flat plate like the conventional case. In the impeller 11, a fluid pressure was measured in a fuel passage defined by the through hole 12 and the recess grooves 7*b*, 8*d* formed in the first and second plates 7 and 8, and the measured result is shown by isobars. According to the result, a high-pressure region is formed at the peripheral portion of the intake and outlet portions, that is, the radial inner and outer sides 12*c*, 12*d*. It was found that the high-pressure region formed is wider than in the case using the conventional impeller. As is evident from the description, even if the inner and outer sides 12*c*, 12*d* are not formed into a V-shape, the area increases, and the flow velocity of the fuel is made high and, thus, the pump efficiency can be improved.

Moreover, in an impeller 13 of the third embodiment shown in FIG. 7(B), the rotating direction leading and trailing surfaces 13*a*, 13*b* constituting the through hole are formed radially along a radial line of the impeller. These leading and trailing surfaces 13*a*, 13*b* have a flat surface instead of the V-shape, and the radial inner surface 13*c* is formed is inclined and the radial outer surface 13*d* is flat. The radial inner and outer surfaces 13*c*, 13*d* of the impeller 13 are configured so that their rotating direction leading sides (or corners with leading surface 13*a*) are positioned to the inner-radial side, and thereby, an area for guiding fuel is wider. Therefore, in the impeller 13, the flow of fuel is concentrated on the main flow vortex, so that the pump efficiency is improved.

What is claimed is:

1. An impeller for a liquid pump, which is provided in a pump chamber formed with an intake port and an outlet port, and rotates so that a liquid taken from the intake port can be pumped from the outlet port, comprising:

a plurality of through holes penetrating the thickness of a disk plate member and formed at an outer periphery of the disk plate member adjacent the circumference thereof; and a plurality of vanes formed between adjacent through holes, a radial inner surface of each though hole being inclined from a thickness direction intermediate portion to an inner-radial side in order to guide a liquid to the thickness direction intermediate portion side, the inner-radial side being inclined so that a rotating direction leading side is positioned to the inner-radial side in order to secure wider area for guiding the liquid.

2. The impeller for a liquid pump according to claim 1, wherein a radial outer surface of each though hole is inclined so that its rotating direction leading side is positioned to the inner-radial side.

3. The impeller for liquid pump according to claim 2, wherein the radial outer surface of each though hole is inclined from the thickness direction intermediate portion to an outer-radial side of the through hole.

4. The impeller for liquid pump according to claim 3, wherein the rotating direction leading and trailing surfaces of the through hole are inclined from the thickness direction intermediate portion to the rotating direction leading side.

5. The impeller for liquid pump according to claim 4, wherein the rotating direction leading and trailing surfaces of the through hole are inclined with respect to a radial line of the impeller so that their outer-radial sides are positioned to the rotating direction leading side.

6. The impeller for liquid pump according to claim 3, wherein the rotating direction leading and trailing surfaces of the through hole are inclined with respect to a radial line of the impeller so that their outer-radial sides are positioned to the rotating direction leading side.

7. The impeller for liquid pump according to claim 2, wherein the pump chamber is formed with a ring recess groove for a fluid passage, the ring recess groove facing a vane forming portion, and an inner-radial edge portion of the ring recess groove faces the rotating direction leading surface of the through hole and an outer-radial edge portion of the ring recess groove faces the rotating direction trailing surface thereof.

8. The impeller for liquid pump according to claim 2, wherein the rotating direction leading and trailing surfaces of the through hole are inclined from the thickness direction intermediate portion to the rotating direction leading side.

9. The impeller for liquid pump according to claim 2, wherein the rotating direction leading and trailing surfaces of the through hole are inclined with respect to a radial line of the impeller so that their outer-radial sides are positioned to the rotating direction leading side.

10. The impeller for liquid pump according to claim 1, wherein the radial outer surface of each though hole is inclined from the thickness direction intermediate portion to an outer-radial side of the through hole.

11. The impeller for liquid pump according to claim 10, wherein the pump chamber is formed with a ring recess groove for a fluid passage, the ring recess groove facing a vane forming portion, and an inner-radial edge portion of the ring recess groove faces the rotating direction leading surface of the through hole and an outer-radial edge portion of the ring recess groove faces the rotating direction trailing surface thereof.

12. The impeller for liquid pump according to claim 11, wherein the rotating direction leading and trailing surfaces of the through hole are inclined with respect to a radial line of the impeller so that their outer-radial sides are positioned to the rotating direction leading side.

13. The impeller for liquid pump according to claim 10, wherein the rotating direction leading and trailing surfaces of the through hole are inclined from the thickness direction intermediate portion to the rotating direction leading side.

14. The impeller for liquid pump according to claim 13, wherein the rotating direction leading and trailing surfaces of the through hole are inclined with respect to a radial line of the impeller so that their outer-radial sides are positioned to the rotating direction leading side.

15. The impeller for liquid pump according to claim 10, wherein the rotating direction leading and trailing surfaces of the through hole are inclined with respect to a radial line of the impeller so that their outer-radial sides are positioned to the rotating direction leading side.

16. The impeller for liquid pump according to claim 1, wherein the pump chamber is formed with a ring recess groove for a fluid passage, the ring recess groove facing a vane forming portion, and an inner-radial edge portion of the ring recess groove faces the rotating direction leading surface of the through hole and an outer-radial edge portion of the ring recess groove faces the rotating direction trailing surface thereof.

17. The impeller for liquid pump according to claim 16, wherein the rotating direction leading and trailing surfaces of the through hole are inclined with respect to a radial line of the impeller so that their outer-radial sides are positioned to the rotating direction leading side.

18. The impeller for liquid pump according to claim 1, wherein the rotating direction leading and trailing surfaces of the through hole are inclined from the thickness direction intermediate portion to the rotating direction leading side.

19. The impeller for liquid pump according to claim 18, wherein the rotating direction leading and trailing surfaces of the through hole are inclined with respect to a radial line of the impeller so that their outer-radial sides are positioned to the rotating direction leading side.

20. The impeller for liquid pump according to claim 1, wherein the rotating direction leading and trailing surfaces of the through hole are inclined with respect to a radial line of the impeller so that their outer-radial sides are positioned to the rotating direction leading side.

* * * * *